US005110402A

United States Patent [19]

Zodrow et al.

[11] Patent Number: 5,110,402

[45] Date of Patent: May 5, 1992

[54] LABELLING MACHINE FOR LABELLING CONTAINERS SUCH AS BOTTLES HAVING A LABELLING BOX FOR A STACK OF LABELS IN A LABELLING STATION

[75] Inventors: Rudolf Zodrow; Rainer Buchholz, both of Düsseldorf, Fed. Rep. of Germany

[73] Assignee: Holstein und Kappert AG, Dortmund, Fed. Rep. of Germany

[21] Appl. No.: 676,708

[22] Filed: Mar. 28, 1991

[30] Foreign Application Priority Data

Mar. 28, 1990 [DE] Fed. Rep. of Germany ..... 4010974
Sep. 5, 1990 [DE] Fed. Rep. of Germany ..... 4109335

[51] Int. Cl.[5] ..... B65C 9/00

[52] U.S. Cl. ..... 156/573; 156/364; 156/568; 156/571; 156/DIG. 29; 271/124; 271/136; 271/137

[58] Field of Search ..... 156/565, 564, 568, 570, 156/571, 573, DIG. 29, DIG. 30, DIG. 32, 364; 271/33, 99, 124, 136, 137, 138

[56] References Cited

U.S. PATENT DOCUMENTS 4,439,262 3/1984 Zodrow et al. ..... 156/571 X

FOREIGN PATENT DOCUMENTS 1934399 12/1970 Fed. Rep. of Germany .
7223328 9/1972 Fed. Rep. of Germany .
2139662 3/1974 Fed. Rep. of Germany .
2528929 12/1976 Fed. Rep. of Germany .
3245879 10/1985 Fed. Rep. of Germany .

*Primary Examiner*—David A. Simmons
*Assistant Examiner*—James J. Engel, Jr.
*Attorney, Agent, or Firm*—Nils H. Ljungman & Associates

[57] ABSTRACT

This invention relates to a label box for a label stack in a labelling station. The label box has a front part, which is designed as a slide which can move forward and backward in relation to the other part. If a label is not to be extracted from the stack, this front part is moved back, compressing the label stack, so that the front end surface of the label stack is in an idle position, in which the pickup surface of the extractor element for the labels can no longer make contact against the end surface of the label stack as it rolls past.

20 Claims, 3 Drawing Sheets

LABELLING MACHINE FOR LABELLING CONTAINERS SUCH AS BOTTLES HAVING A LABELLING BOX FOR A STACK OF LABELS IN A LABELLING STATION

FIELD OF THE INVENTION

This invention relates to a labelling machine having a label box for a stack of labels in a labelling station with at least one extractor element located on a turntable so that the extractor element can rotate or pivot.

BACKGROUND OF THE INVENTION

This invention relates to a labelling machine having a label box for a stack of labels in a labelling station with at least one extractor element located on a turntable so that the extractor element can rotate or pivot. The extractor element, with its convexly curved pickup surface to which adhesive can be applied by an adhesive application device, can be rolled past the end surface of the stack of labels. To guide the stack of labels, there are guide elements which are located on the sides and bottom of the stack and which extend to the front side of the stack. The stack of labels can be pushed, on one hand, from its back side and, on the other hand, on its front side by holding elements which overlap the edge of the stack, and with a regulating device, which device transfers the label box together with the labels in it from the rolling contact position on the front side of the stack into a retracted idle position.

With a label box which can move forward and backward, it is possible to precisely control the extraction of the label from the stack of labels and thus also the transfer of the label to the object to be labelled. This control is carried out so that no label is extracted if, on account of the absence of an object to be labelled in a series, it is not possible to transfer a label. Without this control, in the absence of an object to be labelled, a label would still be extracted, but that would lead to disruptions in the further extraction and transfer of the label, because the label extracted from the label stack but not transferred to the object to be labelled would be covered by a new label taken from the stack.

As a solution for this requirement, to prevent the extraction of a label from the stack by the extractor element, the former designs include not only the backward movement of the entire label box, but also the activation of holding elements which act on the end surface of the label stack or additional holding elements, so that the pressure exerted by them on the end surface of the label stack and the related compression on at least the front edge of the label stack in the rolling contact direction reduces the contact pressure of the rolling pickup surface, so that the adhesive force of the adhesive is not sufficient during the rolling process to extract the forward label from the stack. In this solution, in contrast to the first solution with the adjustable label box, the label box is not moved. Rather, this solution is based on the principle that the holding elements hold the labels so tight that in spite of the full-contact rolling of the pickup surface of the extraction element on the end surface of the label stack, the label cannot be extracted. In the extreme case, however, it is also possible to activate all the holding elements so strongly that the end surface of the label stack is moved back so far that the pickup surface of the extractor element no longer contacts the end surface. In this case, considerable effort is required to activate and control the many holding elements (German Patent Application No. 32 45 879 C2).

In another former labelling machine, each holding element designed as a small hook overlapping the front edge of the label stack, does not have its own hydraulic or pneumatic cylinder, but the small hooks are guided in guide rails so that the hooks can move along the label box, and can be coupled to one another by means of a frame for joint movement by means of a hydraulic cylinder. In this solution, the guide rails end shortly in front of the front side of the stack. That means that there is no precise guidance in exactly the area in which a precise extraction of labels from the stack is necessary (German Patent No. 21 39 662).

OBJECT OF THE INVENTION

The object of the invention is to create a label box for a label stack in a labelling station in which, if no label is to be extracted, it is generally not necessary either to move back the heavy weight of the label box or to move the end surface of the label stack out of the rolling contact area of the pickup surface of the extractor element. Also, it is generally not necessary to have a large number of controllable holding elements located over the entire edge of the end surface of the label stack for that purpose. The object of the invention may be achieved without thereby adversely affecting the precise guidance of the labels to the front side of the stack.

SUMMARY OF THE INVENTION

The object of the present invention is achieved by the invention in that the guide elements are preferably designed for a more precise guidance of the label stack in the forward portion of the label box than in the other portion, and, together with the holding elements, form a movable slide in relation to the guide elements in the other part, and the slide is moved by a drive between the rolling contact position and the idle position.

The solution according to the invention takes advantage of the compressibility of the label stack, if by means of the slide, the front portion of the label stack is moved back, to allow an idling of the extractor element at the label stack. The weight to be moved is generally small compared to the weight of the entire label box with the stack of labels contained in it. In other words, the control can even be exercised when the machine is operating at high rates of production. A large number of controllable holding elements are generally no longer necessary for the retraction of the end surface of the label stack. Rather, these holding elements can be made rigid, as on a label box which moves as a unit, so that no specially configured pickup surfaces are generally necessary for the extractor element, as may be necessary for movable holding elements. Since the holding elements may be moved not in relation to the end surface of the label stack, but only to the entire slide, the load exerted on the end surface of the stack by the holding elements may be small, so that there may also be no substantial damage caused to the labels by the control movements. Since in the forward area, the guide elements tend to closely surround the label stack up to the front side of the stack, not only is there generally good guidance of the labels to the front side, but also substantially little movement of this portion of the stack in relation to the guide elements during the control movements. In other words, during the control movement, the stack tends not to lag behind, and, thus, suboptimal rolling contact conditions tend not to be created during the extraction of a label by the extraction element.

Since the weight to be controlled is generally not excessively great, it is possible with one embodiment of the invention, when several label boxes are located above one another, to drive the slides of the label boxes with one and the same actuator drive.

In another embodiment of the invention, the forward and the remaining portion of the label box have guide strips running in a substantially axial direction with respect to the stack of labels. The strips are preferably engaged in one another in the manner of gear teeth in a transition zone between the forward and rear portions of the label box.

There are various alternatives for the drive of the slide. According to a first alternative, a crank drive may be used as the drive for the sliding front portion of the label box. In that case, there is preferably a damping element in the tie rod and connecting rod of the crank drive, to keep the load on the labels on the front of the stack as small as possible during control movements. According to a second alternative, a positioning piston-cylinder arrangement is may be used as a drive for the sliding front portion of the label box. In such a case, the front portion of the label box should generally thereby be mounted in a guide with, in particular, damped stops for the two control positions, so that in this case, too, the load on the front side of the label stack may be kept as low as possible during the control movements. With both alternative drives for the sliding portion, it is possible to achieve a control distance large enough so that, in the idle position, the front side of the stack may be located a sufficiently safe distance away from the rolling contact surface of the extractor element. Therefore, it is generally not absolutely necessary for the rear portion of the label box to also be retracted by means of a drive. Nevertheless, if such a retraction is required, the retraction can be advantageously realized in the context of the invention by designing the rear portion of the label box as a car or sled which can be moved by means of a drive. It should be appreciated that, the front part of this car or sled can be moved by means of its own drive such as was already mentioned in relation to the slide which can be regulated by means of its own drive. This embodiment means that, in longer phases, in which no label is to be extracted, the label box can be placed in a position which is even further recessed, such that the end surface of the label stack, which may possibly be moved slightly forward as a result of vibrations acting over a rather long period, can be kept at a safe distance from the pickup surface of the extractor element.

A crank drive can be used as the drive for the other, rear portion of the label stack. On account of the high acceleration forces which occur there, a damping element should be located in the tie rod and connecting rod.

BRIEF DESCRIPTION OF THE DRAWINGS

The invention is explained in greater detail below with reference to one embodiment which is illustrated in the accompanying drawings.

DESCRIPTION OF THE PREFERRED EMBODIMENTS

Figure 1:
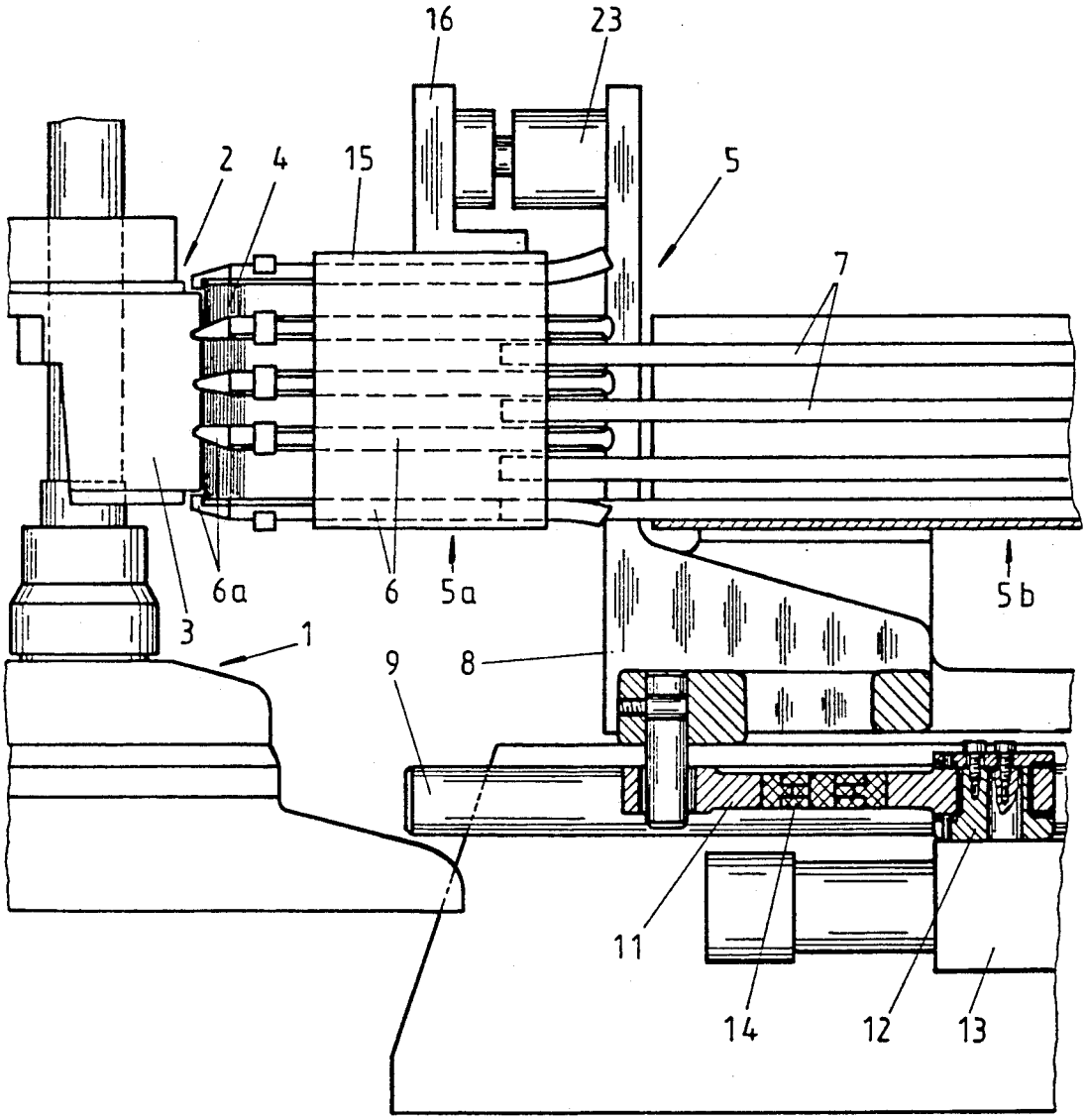
FIG. 1 shows, in a side view and in partial cross section, a labelling station in detail with an extractor element and a label box which holds a stack of labels.
Figure 2:
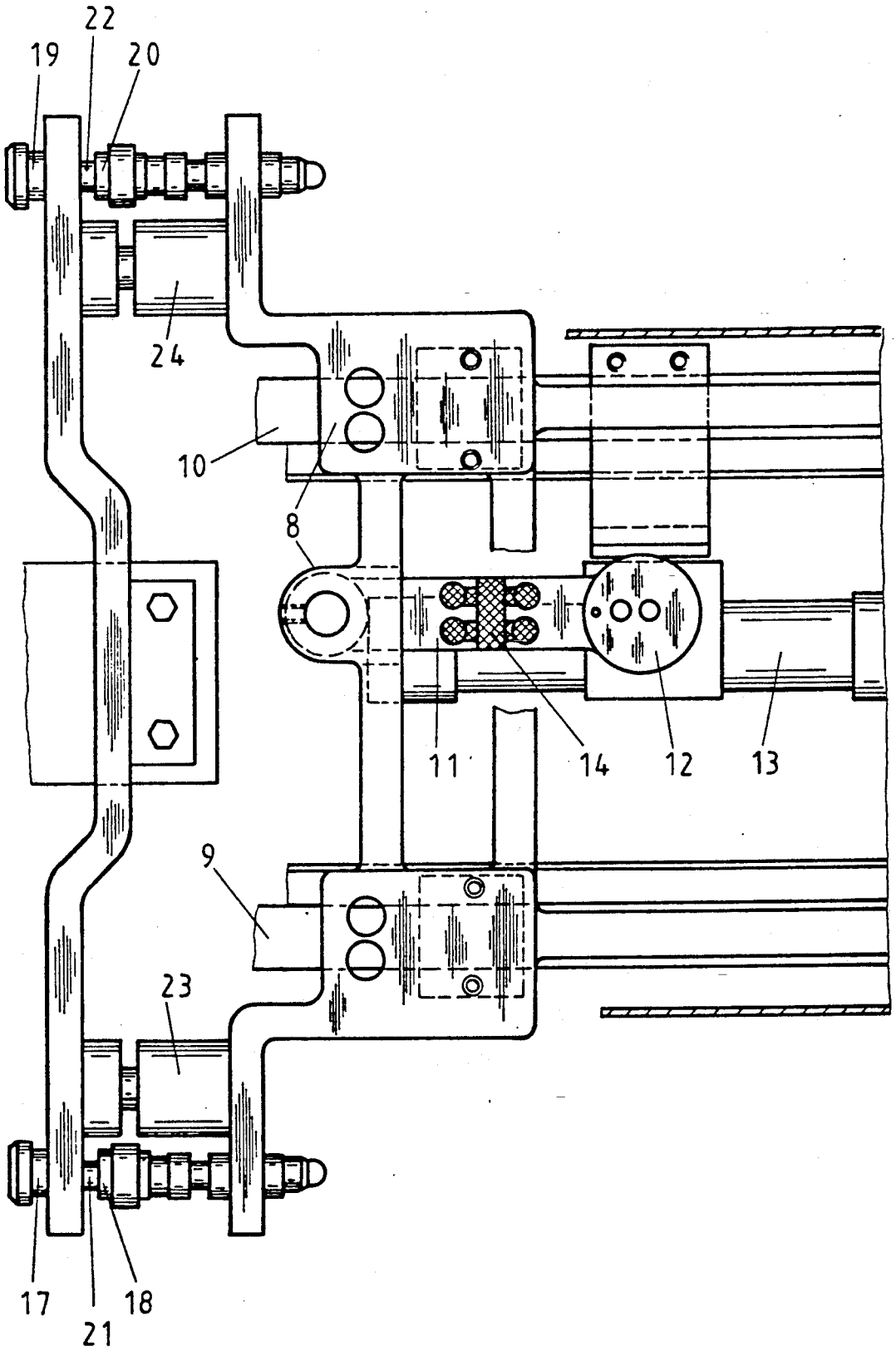
FIG. 2 shows the label box in FIG. 1, in detail and in an overhead view.

Preferably, according to the embodiment illustrated in FIG. 1 and FIG. 2, on a turntable 1 there is an extractor element 2 with a cylindrically curved pickup surface 3. The extractor element 2 is mounted so that it can rotate. The rotational movement of the extractor element 2 is generally uneven, so that the extractor element 2 rolls in contact past different stations, such as an adhesive device, a label storage station and a label transfer station. If the extractor element 2 with its adhesive-bearing pickup surface 3 rolls past the end surface of a label stack 4, it generally removes the front label from this label stack 4 in the label storage station, on account of the adhesive action of the adhesive.

Preferably, the label stack 4 is movably held in a label box 5. Pressure is usually applied to the back of the stack 4 located in the label box 5 by means, such as a spring, not shown in the drawing. The label box 5, in a front part **5*a*, preferably has axially oriented guide rails 6 on all sides, and in a rear part 5*b*, the label box 5*b* preferably has axial guide rails 7 on the sides and on the bottom. Preferably, the front guide rails 6 are designed for guidance of the label stack with no play, while the rear guide rails 7 are designed for a guidance of the label stack allowing some play. Preferably, these two sets of guide rails 6, 7 are alternately engaged in one another in a transition zone in the manner as that of gear teeth in mesh. The rear area 5*b* of the label box 5 is preferably installed on a car or sled 8, which can be moved on rails 9, 10. The drive mechanism for the sled 8 is preferably a crank drive with a tie rod and connecting rod 11 and a crank 12 designed preferably as a cam, which crank can be rotated by a drive 13 between two positions. In the tie rod and connecting rod 11, there is preferably disposed an elastic, damping transmission element 14**.

In other words, for example, in one of the preferred embodiments of the invention, the crank 12 is driven in a rotating fashion by a drive mechanism 13 (for example, an electrical rotary motor), and the rotation of the crank 12 is converted to a reciprocating movement of the sled 8 due to the off-center attachment of the rod and connecting rod 11 to the crank 12. Moreover, preferably elastic, damping transmission element 14 is provided to absorb any excess shock forces created during the reversal points of sled 8 Specific details of the precise construction of the drive mechanism 13, the crank 12, the tie rod and connecting rod 11 and the elastic damping element 14 are well within the knowledge of one of ordinary skill in the mechanical arts and are, therefore, not discussed in any further detail herein.

The front part **5*a* of the label box 5 is preferably designed as a slide. For this purpose, the guide rails 6 are preferably installed inside a housing 15, which is supported by a support and guide rail 16. The support and guide rail 16 can be moved at both ends, guided on rails 21, 22, between stops 17–20 designed to act as damping bodies. On both ends of the support and guide rail 16, between the ends and the sled 8, there are preferably provided cylinder-piston arrangements 23 24 acting as drives which can exert pressure on both sides. With these cylinder-piston arrangements 23, 24, the front part 5*a* of the label box 5 designed as a slide can be adjusted in relation to the other part 5*b* of the label box 5 between two positions which are defined by the stops 17-20, i.e. a rolling contact position and an idle position. More particularly, at one end of support and guide rail 16, the rolling contact position is defined by stop 17 and the idle position is defined by stop 18. Likewise, at an opposite end of support and guide rail 16, the rolling contact position is defined by stop 19 and the idle position is defined by stop 20. Preferably, during the adjustment from the rolling contact position into the recessed idle position, the labels in the label stack 4, in particular in the front area, are substantially compressed so that the label stack 4 with its end surface is moved back by the holding elements 6***a* gripping it so that the end surface may no longer be contacted by the pickup surface 3 of the extractor element 2. A few millimeters are usually sufficient to achieve this effect. Therefore, and on account of the small weights to be moved, this control process can be realized even at high rates of operation of the labelling station.

The driving action of cylinder-piston arrangements 23 and 24 by which the support and guide rail 16 is afforded linear motion, as well as the cylinder-piston arrangements themselves, are well within the knowledge of one of ordinary skill in the mechanical arts and are, therefore, not discussed in any further detail herein.

If no labels are to be extracted from the stack 4 for a rather long period of time, on the other hand, then the entire label box 5 is preferably moved into the recessed position by means of the crank drive 11, 12. In this case, the distance of the end surface of the stack 4 from the pickup surface 3 in the rolling contact position may be in the range of about 1 to about 2 cm. Such a distance is generally sufficient to prevent any contact between the pickup surface 3 and the end surface of the stack 4, even if the stack 4 is somewhat bowed as a result of vibrations.

Figure 3:
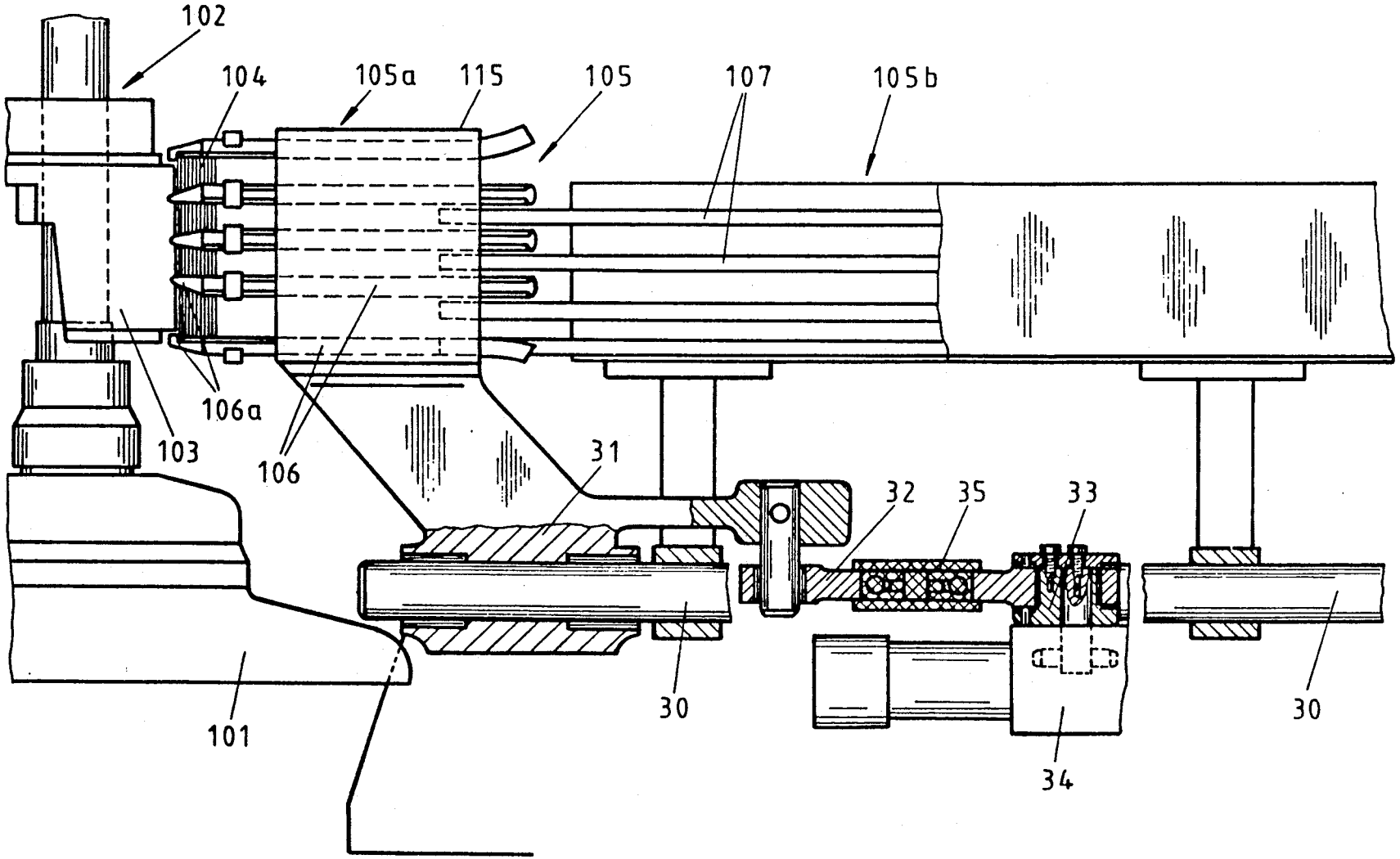
FIG. 3 shows, in a side view and in partial cross section, a labelling station different from the labelling station illustrated in FIG. 1, in detail, with an extractor element and a label box containing a label stack.

The embodiment illustrated in FIG. 3 differs from the one illustrated in FIGS. 1 and 2 essentially in that the rear portion 105*b* of the label box 5 is not adjustable. To simplify and shorten the description, the parts which correspond to the parts in the earlier figures have the same numbers, increased by 100.

The rear portion 105*b* of the label box 5 is preferably held immobile on stationary rails 30. The front portion 105*a* of the label box 105 is preferably installed on a car or sled 31. The car or sled 31 is preferably mounted so that it can move on the rails 30. The drive for the sled 31 is preferably a crank drive with a tie rod and connecting rod 32, and a crank 33 designed as a cam, which crank can be rotated by a drive 34 between two positions. An elastic, damping transmission element 35 is preferably inserted in the tie rod and connecting rod 32. It should be understood that tie rod and connecting rod 32, crank 33, drive 34 and damping transmission element 35 operate in substantially the same manner as described above in relation to the tie and connecting rod 11, crank 12, drive 13 and damping transmission element 14 of another preferred embodiment of the invention.

In this second embodiment, in contrast to the first embodiment, it is usually not possible for the label box to execute an additional adjustment movement into an even further recessed position, if labels are not to be extracted for a long period of time. As before, however, the distance is generally sufficient to prevent the extraction of a label, whereby the load on the front label on the end surface of the label stack is not so great that it would cause damage to the labels.

One feature of the invention resides broadly in a label box for a label stack 4, 104 in a labelling station with at least one extractor element 2, 102 located on a turntable 1, 101 so that it can rotate or pivot, which by means of its convexly curved pickup surface 3, 103 to which adhesive can be applied by an adhesive application device, can be rolled past the end surface of the stack of labels 4, 104, whereby to guide the stack of labels 4, 104 there are guide elements 6, 7, 106, 107 which are located on its sides and bottom and extend to the front side of the stack 4, 104, and whereby the stack of labels can be pushed on one hand on its back side and on the other hand on its front side by holding elements 6*a*, 106*a* which overlap its edge, and with an adjustment apparatus 15-24, 115, 31-35, which transfers the label box together with the stack in it 4, 104 from the rolling contact position on the front side of the stack 4, 104 into a retracted idle position, characterized by the fact that the guide elements 6, 106 and 7, 107 in the front portion of the label box 5, 105 are designed for a more precise guidance of the label stack 4, 104 than in the other part, and together with the holding elements 6*a*, 106*a* form a slide 6, 6*a*, 15, 106, 106*a*, 115 which can move in relation to the guide elements 7, 107 in the other portion, which slide can be moved by means of a drive 23, 24, 32-34 between the rolling contact position and the idle position.

Another feature of the invention resides broadly in a label box characterized by the fact that the guide elements 6, 7, 106, 107 of the front portion and the other portion of the label box 5, 105 are designed as guide strips which run axially, and are engaged with one another in the manner of gear teeth in the transition zone.

Yet another feature of the invention resides broadly in a label box characterized by the fact that when there are two similar label boxes located one above the other with slides, there is a joint drive for the slides.

A yet further feature of the invention resides broadly in a label box characterized by the fact that the drive 32-34 is a crank drive.

A still yet further feature of the invention resides broadly in a label box characterized by the fact that there is a damping element 35 located in the tie rod and connecting rod 32 of the crank drive 32-34.

A yet still further feature of the invention resides broadly in a label box characterized by the fact that the rear portion 105*b* of the label box 105 is stationary.

A further feature of the invention resides broadly in a label box characterized by the fact that the drive 23, 24 is a positioning cylinder-piston arrangement.

A still another feature of the invention resides broadly in a label box characterized by the fact that the front portion 5*a* of the label box 5 is mounted in a guide 21, 22 with damped stops 17-20 for the two adjustment positions.

A yet still another feature of the invention resides broadly in label box characterized by the fact that the remaining part 5*b* of the label box 5 is designed as a car or sled 8 which can be moved by a drive 11, 12, 13, and on this car or sled 8, the front part 5*a* can be moved by means of its own drive 23, 24.

A still yet further feature of the invention resides broadly in a label box characterized by the fact that the drive 11, 12, 13 for the remaining part 5*b* of the label box 5 is a crank drive 11, 12.

A yet still further feature of the invention resides broadly in a label box characterized by the fact that there is a damping element 14 in the tie rod and connecting rod 11 of the crank drive 11, 12.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A label box in a labelling station of a labelling machine, wherein said label box is for holding a plurality of labels and said labelling machine comprises means for extracting the labels from said label box, said label box comprising:

means for guiding the labels towards the extracting means;

means for retaining a portion of the labels in the vicinity of the extracting means;

said label box comprising a forward portion and a rear portion, said forward portion being disposed towards said extracting means and said rear portion being disposed generally away from said extracting means and adjacent to said forward portion;

said retaining means being disposed in said forward portion of said label box;

said retaining means being slidingly displaceable with respect to said rear portion of said label box; and means for displacing said retaining means between:

a first position, wherein the labels are positioned to permit the extraction of the labels from said label box by the extracting means; and a second position, wherein the labels are positioned to prevent the extraction of the labels from said label box by the extracting means.

2. The label box according to claim 1, wherein said retaining means comprises a plurality of retaining elements being fixed with respect to one another.

3. The label box according to claim 2, wherein said forward portion of said label box is slidingly displaceable with respect to said rear portion by said displacing means to effect the displacement of said retaining means between said first position and said second position.

4. The label box according to claim 3, further comprising:

at least a portion of said guiding means being disposed in said forward portion;

at least a portion of said guiding means being disposed in said rear portion; and said retaining means being an integral extension of said at least a portion of said guiding means of said forward portion.

5. The label box according to claim 4, wherein said guiding means comprises a plurality of guiding elements.

6. The label box according to claim 5, further comprising:

said label box defining a longitudinal direction generally parallel to a direction of travel of the labels through said label box;

said guiding elements comprising a plurality of guiding strips;

said guiding strips being disposed parallel to the longitudinal direction of said label box; and said guiding strips of said forward portion being slidingly meshed with said guiding strips of said rear portion.

7. The label box according to claim 6, wherein the labels have at least one edge and said retaining elements are for overlapping the at least one edge of the labels.

8. The label box according to claim 7, wherein said guiding means of said forward portion are configured for a generally more precise guidance of the labels than in said rear portion.

9. The label box according to claim 8, further comprising:

said label box being a first label box;

a second label box being disposed adjacent said first label box;

said second label box having a forward portion and a rear portion disposed adjacent said forward portion;

said forward portion of said second label box being slidingly displaceable with respect to said rear portion of said second label box; and said displacing means for simultaneously displacing said forward portion of said first label box and said forward portion of said second label box.

10. The label box according to claim 9, wherein said displacing means comprises at least one of a crank drive; and cylinder and piston means.

11. The label box according to claim 10, wherein said crank drive has damping means for damping the movement of said crank drive.

12. The label box according to claim 11, further comprising:

said crank drive comprising a tie rod and a connecting rod; and said damping means of said crank drive being disposed in said tie rod and said connecting rod.

13. The label box according to claim 12, wherein said rear portion of said label box is stationary.

14. The label box according to claim 13, further comprising:

guiding means for guiding the displacement of said forward portion of said label box; and said forward portion of said label box being mounted in said guiding means.

15. The label box according to claim 14, wherein said guiding means for guiding the displacement of said forward portion of said label box comprises damped stops for defining said first position and said second position.

16. The label box according to claim 15, further comprising:

said forward portion of said label box having a smaller longitudinal dimension than said rear position;

the displacement of said forward portion of said label box being along the longitudinal direction of said label box;

a longitudinal distance between said first position and said second position of said label box being about a few millimeters;

each of said holding elements corresponding to one of said guiding strips such that each of said holding elements is an integral extension of its corresponding one of said guiding means for holding in parallel said holding elements of said forward portion of said label box;

said cylinder-and-piston means comprising two cylinders, each of said two cylinders having piston means;

said two cylinders being disposed in parallel;

said stop means comprising two sets of two damped stops;

said two sets of two damped stops being disposed in parallel;

each of said two sets of two damped stops comprising:

one of said two damped stops defining said first position;

the other of said two damped stops defining said second position;

second rail means for guiding the displacement of said forward portion of said label box; and the labels for being arranged in a single stack in said label box.

17. The label box according to claim 13, wherein said rear portion of said label box is displaceable along the longitudinal direction of said label box.

18. The label box according to claim 17, further comprising:

guiding means for guiding the displacement of said forward portion of said label box; and said forward portion of said label box being mounted in said guiding means.

19. The label box according to claim 18, wherein said guiding means for guiding the displacement of said forward portion of said label box comprises damped stops for defining said first position and said second position.

20. The label box according to claim 19, further comprising:

said rear portion of said label box comprising one member of the group consisting essentially of: a) car means and b) sled means;

a rear crank drive for displacing said rear portion of said label box;

said rear crank drive comprising:

damping means for damping the movement of said rear crank drive;

a tie rod and a connecting rod;

said damping means being disposed in said tie rod and said connecting rod;

said forward portion of said label box having a smaller longitudinal dimension than said rear portion;

the displacement of said forward portion of said label box being along the longitudinal direction of said label box;

a longitudinal distance between said first position and said second position of said label box being about a few millimeters;

said rear portion of said label box being displaceable between a third position and fourth position;

a longitudinal distance between said third position and said fourth position of said rear portion of said label box being about a few centimeters;

rail means for guiding the displacement of said rear portion of said label box;

each of said holding elements corresponding to one of said guiding strips such that each of said holding elements is an integral extension of its corresponding one of said guiding strips;

means for holding in parallel said holding elements of said forward portion of said label box;

said cylinder-and-piston means comprising two cylinders, each of said two cylinders having piston means;

said two cylinders being disposed in parallel;

said stop means comprising two sets of two damped stops;

said two sets of two damped stops being disposed in parallel;

each of said two sets of two damped stops comprising:

one of said two damped stops defining said first positions;

the other of said two damped stops defining said second position;

the longitudinal distance between said third position and said fourth position of said rear portion of said label box being between about 1 centimeter and about 2 centimeters;

second rail means for guiding the displacement of said forward portion of said label box; and the labels for being arranged in a single stack in said label box.

* * * * *

UNITED STATES PATENT AND TRADEMARK OFFICE

CERTIFICATE OF CORRECTION

PATENT NO. :5,110,402

DATED :May 5, 1992

INVENTOR(S) :Rainer BUCHHOLZ and Rudolf ZODROW

It is certified that error appears in the above-indentified patent and that said Letters Patent is hereby corrected as shown below:

On the title page, item 30, line 2, delete "Sep. 5, 1990" and insert --March 22, 1991--.

On the title page, item 30, add:

--Sep. 5, 1990 Fed. Rep. of Germany 4028114--.

Column 8, line 35, Claim 10, delete "cylinder and piston" and insert --cylinder-and-piston--.

Column 9, line 4, Claim 16, after 'guiding', insert --strips;--.

Column 10, line 37, Claim 20, delete "positions" and insert --position;--.

Signed and Sealed this

Nineteenth Day of July, 1994

Bruce Lehman

*Attest:*

BRUCE LEHMAN

*Attesting Officer*

*Commissioner of Patents and Trademarks*